United States Patent [19]

Hall et al.

[11] 4,373,920

[45] Feb. 15, 1983

[54] MARINE PROPULSION DEVICE STEERING MECHANISM

[75] Inventors: Charles B. Hall, Ingleside; Edward D. McBride, Waukegan, both of Ill.; Robert F. Young, Kenosha, Wis.

[73] Assignee: Outboard Marine Corporation, Waukegan, Ill.

[21] Appl. No.: 173,158

[22] Filed: Jul. 28, 1980

[51] Int. Cl.[3] ..... B63H 21/26

[52] U.S. Cl. ..... 440/59; 440/61

[58] Field of Search ..... 440/58, 59, 60, 61, 440/63, 53, 62; 114/150, 144 R

[56] References Cited

U.S. PATENT DOCUMENTS

| | | | |
|---|---|---|---|
| 2,028,089 | 1/1936 | Erling | 114/150 |
| 2,875,722 | 3/1959 | Post | 114/144 R X |
| 2,939,417 | 6/1960 | Hammock, Sr. | 440/61 X |
| 2,961,986 | 11/1960 | Rockhill | 114/144 R |
| 3,063,244 | 11/1962 | Wilkins | 60/52 |
| 3,121,415 | 2/1964 | Anderson et al. | 440/59 |
| 3,240,452 | 3/1966 | Cheeseboro | 440/61 X |
| 3,631,833 | 1/1972 | Shimanckas | 91/216 A X |
| 3,772,966 | 11/1973 | Mills | 92/66 |
| 3,774,568 | 11/1973 | Borst et al. | 114/144 R |
| 3,832,967 | 9/1974 | Warner et al. | 114/144 R |
| 4,041,889 | 8/1977 | Blanchard | 440/61 X |
| 4,054,102 | 10/1977 | Borst et al. | 114/144 R |

*Primary Examiner*—Sherman D. Basinger

*Attorney, Agent, or Firm*—Michael, Best & Friedrich

[57] ABSTRACT

Disclosed herein is a marine propulsion device comprising a bracket adapted to be fixed relative to a boat transom, a propulsion unit including a steering arm, pivots pivotally connecting the bracket and the propulsion unit for vertical pivotal movement of the propulsion unit about a tilt axis which is substantially horizontal when the bracket is boat mounted, and for swinging movement of the propulsion unit about a steering axis which is generally transverse to the horizontal axis, a support rod fixed in spaced parallel rotation to the bracket and against movement axially of the horizontal axis and for tilting movement in common with the propulsion unit, a member carried by the support rod for movement axially of the support rod, a coupling connecting the member and the steering arm for swinging the propulsion unit about the steering axis in response to movement of the member axially of the support rod, and mechanism for selectively displacing the member axially of the support rod to thereby steer the propulsion unit.

38 Claims, 6 Drawing Figures

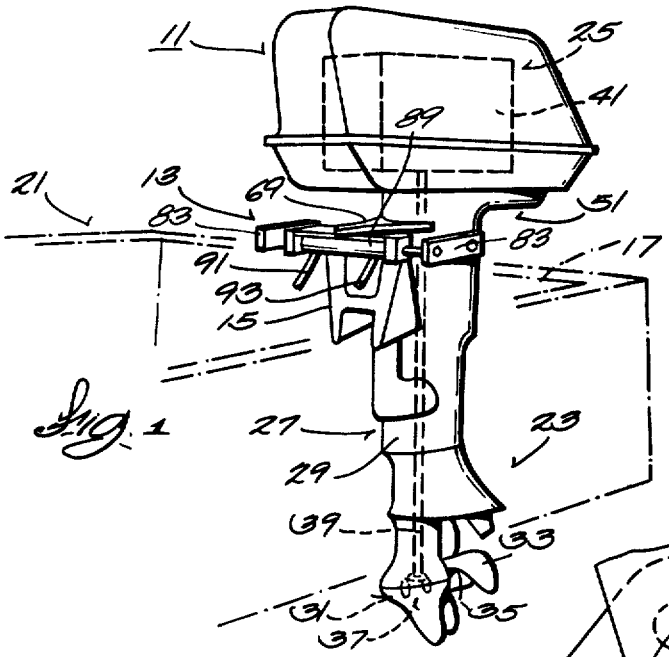
Fig. 1
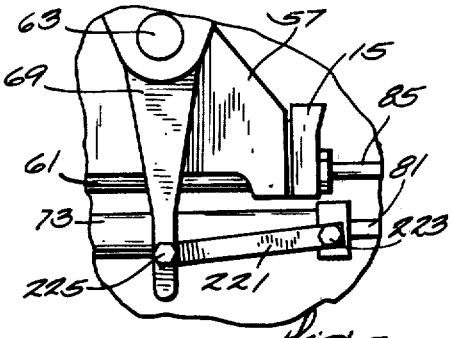
Fig. 5
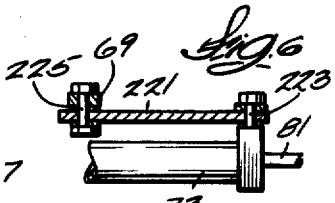
Fig. 6
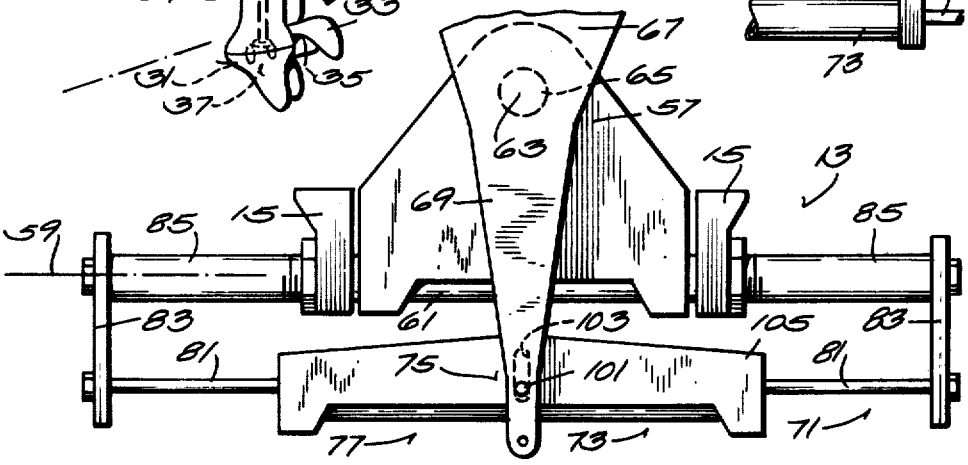
Fig. 2
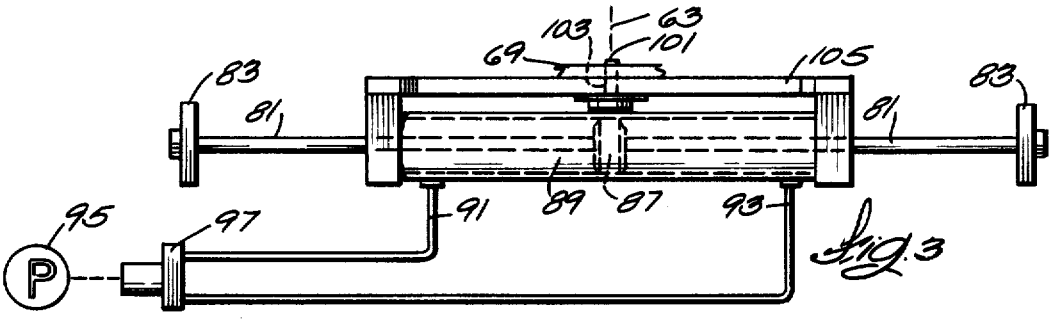
Fig. 3
Fig. 4
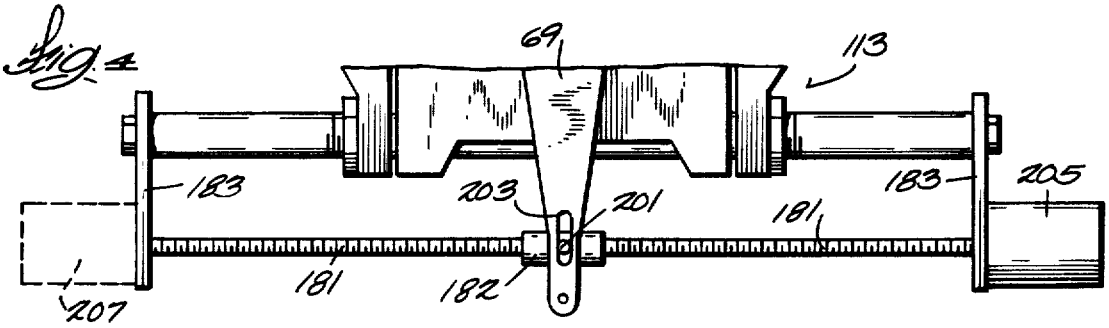

MARINE PROPULSION DEVICE STEERING MECHANISM

RELATED APPLICATIONS

Reference is hereby made to the following related applications, all of which are assigned to the assignee of this application and incorporated herein by reference:

Stevens application Ser. No. 159,480, filed June 16, 1980, and entitled OUTBOARD MOTOR WITH ELEVATED HORIZONTAL PIVOT AXIS and now U.S. Pat. No. 4,355,986.

Blanchard application Ser. No. 167,337, filed July 19, 1980, and entitled OUTBOARD MOTOR WITH DUAL TRIM AND TILT AXES.

Hall et al application Ser. No. 173,159, filed July 28, 1980, and entitled OUTBOARD MOTOR WITH TILT LINKAGE INCLUDING PIVOT LINK and now U.S. Pat. No. 4,354,848.

Hall et al application Ser. No. 183,209, filed Sep. 2, 1980, and entitled HYDRAULIC SYSTEM FOR OUTBOARD MOTOR WITH SEQUENTIALLY OPERATING TILT AND TRIM MEANS.

Hall et al application Ser. No. 173,160, filed July 28, 1980, and entitled OUTBOARD MOTOR WITH SEQUENTIALLY OPERATING TILT AND TRIM MEANS.

Hall et al application Ser. No. 173,162, filed July 28, 1980, and entitled LATERAL SUPPORT ARRANGEMENT FOR OUTBOARD MOTOR WITH SEPARATE TILT AND TRIM AXIS.

BACKGROUND OF THE INVENTION

The invention relates generally to marine propulsion devices, such as outboard motors and stern drive units. More particularly, the invention relates to steering mechanisms for such outboard motors and stern drive units.

In one type of prior steering mechanism, the steering arm of the marine propulsion unit was connected to a steering link extending to one side of the motor and which, at some point, was supported by the boat remotely from the propulsion device. As a result, and because the connection of the steering arm and the steering link travel in one arc in response to steering and in another arc in response to tilting, such arrangements commonly included connection of the steering link to the boat and to the steering arm by arrangements affording universal movement. In addition, tilting of the propulsion unit usually caused steering movement of the propulsion unit.

Examples of the just mentioned prior steering mechanisms are illustrated in the following patents:

Shimanekas U.S. Pat. No. 3,631,833, Jan. 4, 1972.

Waner U.S. Pat. No. 3,832,967, Sept. 3, 1974.

Rockhill U.S. Pat. No. 2,961,986, Nov. 29, 1960.

In another previous type of steering mechanism, the steering mechanism was mounted, in part, in the tilt tube for common tilting movement with the swivel bracket. In these systems, a drag link was connected between the steering arm and a link or steering member which usually extended through the tilt tube and to one side of the installation for connection with the drag link. The connections included in these mechanisms often resulted in undesirable bending moments on the mechanism. Specifically, because the link or steering member moved in a straight line through the tilt tube, and the steering arm moved in a arc, a moment was caused by the angular relationship between the moveable member and the drag link. The linear movement of the junction between the drag link and the moveable member also made support for that member difficult.

Examples of the just mentioned prior steering mechanisms are illustrated in the following patents:

Post U.S. Pat. No. 2,875,722, Mar. 3, 1959.

Borst et al U.S. Pat. No. 3,774,568, Nov. 27, 1973.

Borst et al U.S. Pat. No. 4,054,102, Oct. 18, 1977.

The steering mechanism described hereinafter is believed to overcome various of the disadvantages of the prior systems.

Attention is also directed to the additional following patents:

Erling U.S. Pat. No. 2,028,089, Jan. 14, 1936.

Wilkins U.S. Pat. No. 3,063,244, Nov. 13, 1962.

Mills U.S. Pat. No. 3,772,996, Nov. 20, 1973.

SUMMARY OF THE INVENTION

The invention provides a marine propulsion device comprising a bracket adapted to be fixed relative to a boat transom, a propulsion unit including a steering arm, means pivotally connecting the bracket and the propulsion unit for vertical tilting movement of the propulsion unit about a tilt axis which is substantially horizontal when the bracket is boat mounted, and for swinging movement of the propulsion unit about a steering axis which is generally transverse to the tilt axis, support means fixed relative to the bracket against movement axially of the tilt axis and for tilting movement in common with the propulsion unit, a member carried by the support means for movement therealong in directions parallel to the tilt axis, means connecting the member and the steering arm for swinging the propulsion unit about the steering axis in response to movement of the member along the support means, and means for selectively displacing the member along the support means to thereby steer the propulsion unit.

In one embodiment in accordance with the invention, the means connecting the movable member and the steering arm also provides lost motion between the member and the steering arm in the direction transverse to the tilt axis.

In one embodiment in accordance with the invention, the member comprises a hydraulic cylinder which includes opposite ends and which is movable on the support means in response to selective application of pressure fluid to the opposite cylinder ends.

In one embodiment in accordance with the invention, the support means includes a support rod extending through both of the opposite ends of the cylinder and further including, within the cylinder, a piston fixed on the support rod.

In one embodiment in accordance with the invention, the support means comprises a threaded rod carried for rotation and against axial movement, the member comprises a nut on the threaded rod, and the means for displacing the member comprises a source of rotary power drivingly connected to the rod.

In one embodiment in accordance with the invention, the source of rotary power is a reversible electric motor.

In one embodiment in accordance with the invention, the source of rotary power is a reversible hydraulic motor.

In one embodiment in accordance with the invention, the means connecting the member and the steering arm comprisies a stud on one of the member and the steering arm, and an elongated slot which is located in the other of the member and the steering arm, which receives the stud, and which extends in the direction generally perpendicular to the tilt axis.

In one embodiment in accordance with the invention, the means pivotally connecting the propulsion unit and the bracket includes a tilt tube having opposite ends and tiltable with the propulsion unit, and the support means includes support arms extending from the opposite ends of the tilt tube and a support rod supported by the support arms against movement axially of the tilt tube and in spaced parallel relation to the tilt tube.

Other features and advantages of the embodiments of the invention will become known by reference to the following general description, claims and appended drawings.

IN THE DRAWINGS

FIG. 1 is a perspective view of an outboard motor embodying various of the features of the invention.

FIG. 2 is a partially broken away schematic plan view of a portion of the steering mechanism incorporated in the outboard motor shown in FIG. 1.

FIG. 3 is a front view of the mechanism shown in FIG. 2.

FIG. 4 is a fragmentary view similar to FIG. 2 showing another embodiment of the invention.

FIG. 5 is a fragmentary view of an embodiment of a steering mechanism embodying various of the features of the invention.

FIG. 6 is a fragmentary view taken along lines 6—6 of FIG. 5.

Before explaining two embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is an outboard motor 11 which, except as noted herein with respect to the steering mechanism or arrangement 13 shown best in FIGS. 2 and 3, is generally of conventional construction and includes a transom bracket 15 adapted to be fixed to the transom 17 of a boat 21, together with a propulsion unit 23 which includes a powerhead 25 and a lower unit 27 which is rigidly fixed to the bottom of the powerhead 25 and which includes a drive shaft housing 29 and a lower gear box 31 supporting a propeller 33. As is conventional, the propeller 33 is mounted on a propeller shaft 35 which, in turn, is connected through a reversing transmission 37 with a drive shaft 39 extending through the drive shaft housing 29 and drivingly connected to an internal combustion engine 41 included in the powerhead 25.

The outboard motor 11 also includes means 51 for pivotally supporting the propulsion unit 23 from the transom bracket 15 for tilting and steering movement about transverse tilt and steering axes. While various arrangements can be employed in the illustrated construction, such means comprises a conventional swivel bracket 57 which is pivotally connected to the transom bracket 15 for vertical tilting of the swivel bracket 57 relative to the transom bracket 15 about a horizontal tilt axis 59 provided by a tilt tube 61 extending through aligned aperatures in the transom and swivel brackets 15 and 57. In addition, the swivel bracket 57 and propulsion unit 23 are pivotally connected for steering movement of the propulsion unit 23 relative to the swivel bracket 57 about a vertical steering axis 63 provided by a kingpin 65 which extends through a vertical bore in the swivel bracket 57 and which, at its upper and lower ends, is connected through brackets or arms 67 with the rearwardly located driveshaft housing 29. As is conventional, a steering arm 69 extends fixedly from the top of the kingpin 65 and is essentially rigid with the propulsion unit 23.

In order to effect steering of the propulsion unit 23 relative to the swivel and transom brackets 15 and 57 about the steering axis 63 while, at the same time, accommodating tilting about the horizontal tilt axis 59 of the swivel bracket 57 and propulsion unit 23 relative to the transom bracket 15, there is provided the before mentioned steering mechanism 13 which as shown best in FIGS. 2 and 3, includes elongated support means 71 which is fixed against axial movement relative to the transom bracket 15, which is tiltable relative to the transom bracket 15 to provide common tilting with the swivel bracket 57, and which extends in parallel, preferably forward, relation to the tilt axis 59, a member 73 movable on the support means 71 in the direction of the length thereof, means 75 connecting the member 73 and the steering arm 69 for displacing the steering arm 69 transversely in response to movement of the member 73 lengthwise of the support means 71 and for affording lost motion between the member 73 and the steering arm 69 in the direction transverse to the direction of member movement, and means 77 for selectively displacing the member 73 in the direction of the length of the support means, so as thereby to steer the propulsion unit 23 relative to the swivel bracket 57.

Various arrangements can be provided for providing the support means 71. In the construction illustrated in FIGS. 2 and 3, such support means comprises an elongated support rod 81 which, at its opposite ends, if fixedly supported by respective arms 83 which extend rigidly and radially from oppositely projecting extensions 85 of the tilt tube 61. Preferably, the tilt tube 61 is suitably fixed against axial movement relative to the swivel bracket 57 and is rotatable relative to the transom bracket 15 so as to permit tilting in common with the swivel bracket 57.

Various arrangements can be employed for providing a member moveable along the support rod 81 and for selectively displacing such member. In the construction illustrated in FIGS. 2 and 3, the support rod 81 is provided with a piston 87 which is fixed centrally thereof and which is received in a hydraulic cylinder 89 which includes opposite ends through which the support rod 81 extends, which is moveable relative to the piston 87 and to the support rod 81 in response to selective application thereto of hydraulic fluid, and which constitutes the member 73 moveable along the support rod 81.

Movement of the cylinder 89 along the support rod 81 can be selectively controlled by supplying and draining hydraulic fluid through hydraulic conduits 91 and 93, respectively connected to the cylinder 89 adjacent the opposite ends thereof. Any suitable source 95 of pressure hydraulic fluid and any suitable valving arrangement 97 for selectively applying pressure hydraulic fluid to one cylinder end and draining hydraulic fluid from the other cylinder end can be employed. The details of these components are not believed to be of significance. As is apparent, the pressure fluid source 95 and the valving arrangement 97 can be located remotely for the outboard motor 11.

The means 75 connecting the steering arm 69 and the member 73 comprises a stud 101 extending fixedly from one of the member 73 and the steering arm 69 and received in a slot 103 which is provided in the other of the member 73 and the steering arm 69 and which extends perpendicularly to the direction of travel of the member 73, i.e., perpendicular to the tilt axis 59. In the specifically disclosed construction, the cylinder 89 has fixed thereto a bracket 105 which includes a slot 103 and the stud 101 extends fixedly from the steering arm 69. Any suitable means can be employed to prevent removal or disconnection of the stud 101 from a slot 103.

Shown in FIG. 4 is another embodiment of a steering mechanism 113 in accordance with the invention. The mechanism 113 shown in FIG. 4 differs from the steering mechanism 13 shown in FIGS. 2 and 3, in that a support rod 181 is carried by support arms 183 for rotary travel and held against axial travel. In addition, the support rod 181 is threaded and the member comprises a nut 182 which has fixed thereto a stud 201 extending through a slot 203 in the steering arm 69. Thus, the connection of the nut 182 to the steering arm 69 additionally serves to prevent rotation of the nut 182 with the support rod 181 and thereby to cause axial movement of the nut 182 in response to rotation of the support rod 181. If alternately desired, a guide (not shown) can be carried by the support arms 183 to prevent rotary movement of the nut 182 while permitting movement thereof axially of the support rod 181.

Any suitable means can be providing for selectively rotating the support rod 181. In the disclosed construction, a reversible electric motor 205 is mounted on one of the support arms 183 and is drivingly connected to the support rod 181 by any suitable means. Any suitable control can be employed for selectively energizing the motor 205 for rotation in opposite directions to provide for axial travel of the nut 182 relative to the support rod 181. Alternatively, a rotary hydraulic motor 207, (shown in dotted outline in FIG. 5) suitably supplied with a source of pressure hydraulic fluid and suitably controlled, could be mounted on one of the support arms 183 and drivingly connected to the support rod 181 and could be employed to selectively rotate the nut 181 and thus effect steering of the propulsion unit 23.

Shown fragmentarily in FIGS. 5 and 6 is another steering mechanism which embodies various of the features of the invention. Shown in FIGS. 5 and 6 are the previously disclosed steering arm 69, the swivel bracket 57, the transom bracket 15, the tilt tube 61, and tilt tube extension 65. Also illustrated in FIG. 5 is the previous support rod 81, as well as the member 73 in the form of a hydraulic cylinder as illustrated in FIG. 1. However, as distinguished from the FIG. 1 embodiment, one end of the cylinder pivotally carries, by any suitable means, such as the illustrated stud 223, a drag link 221, which, at its other end, is pivotally connected to the steering arm 69 by any suitable means, such as the illustrated pin 225. In operation, movement of the member 73 axially of the support rod 81 causes accompanying movement of the drag link 221 which, in turn, causes steering movement of the propulsion unit 13.

Various of the features of the invention are set forth in the following claims.

We claim:

1. A marine propulsion device comprising a first bracket adapted to be fixed relative to a boat transom, a propulsion unit including a steering arm, means including a swivel bracket for pivotally connecting said first bracket and said propulsion unit for vertical swinging movement of said propulsion unit about a first axis which is located below said steering arm and which is substantially horizontal when said first bracket is boat mounted, and for swinging movement of said propulsion unit about a steering axis which is generally transverse to the first axis, a support member, spaced means located axially outwardly of said swivel bracket with respect to said first axis and supporting said support member so that said support member is located in spaced parallel relation to said first axis and is retained against movement axially of said first axis while permitting movement of said support member in an arc about said first axis in common with vertical swinging movement of said propulsion unit, a traveling member carried by said support member for movement therealong in directions parallel to said first axis, means connecting said traveling member and said steering arm for applying force to said steering arm so that said steering arm swings said propulsion unit about the steering axis in response to movement of said traveling member along said support member, and means on said support member and on said traveling member for reaction therebetween so as to selectively displace said traveling member along said support member to thereby steer said propulsion unit.

2. A marine propulsion device in accordance with claim 1 wherein said means connecting said traveling member and said steering arm provides lost motion between said traveling member and said steering arm in the direction transverse to the first axis.

3. A marine propulsion device in accordance with claim 1 wherein said traveling member comprises a hydraulic cylinder which includes opposite ends and which is movable on said support member in response to selective application of pressure fluid to said opposite cylinder ends.

4. A marine propulsion device in accordance with claim 3 wherein said support member includes a support rod extending through both of said opposite ends of said cylinder and further including, within said cylinder, a piston fixed on said support rod.

5. A marine propulsion device in accordance with claim 1 wherein said support member comprises a threaded rod carried for rotation and against axial movement, wherein said traveling member comprises a nut on said threaded rod, and wherein said means for displacing said traveling member comprises a source of rotary power drivingly connected to said rod.

6. A marine propulsion device in accordance with claim 5 wherein said source of rotary power is a reversible electric motor.

7. A marine propulsion device in accordance with claim 5 wherein said source of rotary power is a reversible hydraulic motor.

8. A marine propulsion device in accordance with claim 1 wherein said means connecting said traveling member and said steering arm comprises a stud on one of said traveling member and said steering arm, and an elongated slot which is located in the other of said traveling member and said steering armm, which receives said stud, and which extends in the direction generally perpendicular to the first axis.

9. A marine propulsion device comprising a bracket adapted to be fixed relative to a boat transom, a propulsion unit including a steering arm, means pivotally connecting said bracket and said propulsion unit for vertical swinging movement of said propulsion unit about a first axis which is located below said steering arm and which is substantially horizontal when said bracket is boat mounted, and for swinging movement of said propulsion unit about a steering axis which is generally transverse to the first axis, said means pivotally connecting said propulsion unit and said bracket including a tilt tube having opposite ends and tiltable with said propulsion unit, support means fixed against movement axially of said first axis and for vertical swinging movement in common with said propulsion unit about the first axis, said support means including support arms extending from said opposite ends of said tilt tube and a support rod supported by said support arms against movement axially of said tilt tube and in spaced parallel relation to said tilt tube, a member carried by said support rod for movement therealong in directions parallel to the first axis, means connecting said member and said steering arm for applying force to said steering arm so that said steering arms swings said propulsion unit about the steering axis in response to movement of said member along said support rod, and means on said support rod and on said member for reaction therebetween so as to selectively displace said member along said support rod to thereby steer said propulsion unit.

10. A marine propulsion device comprising a first bracket adapted to be fixed relative to a boat transom, a second bracket, means pivotally connecting said first and second brackets for swinging movement of said second bracket relative to said first bracket about a first axis which is substantially horizontal when said first bracket is boat mounted, a propulsion unit including a steering arm extending above said first axis, means pivotally connecting said second bracket and said propulsion unit for steering movement of said propulsion unit relative to said second bracket about a steering axis which is generally transverse to said first axis, a support rod including spaced portions and a piston located centrally between said spaced portions, spaced means located axially outwardly of said second bracket with respect to said first axis and supporting said spaced rod portions so that said rod is located in spaced parallel relation to said first axis and is retained against movement axially of said first axis while permitting movement of said rod in an arc about said first axis in common with swinging movement of said second bracket, a hydraulic cylinder receiving said piston and having opposed ends through which said rod passes, means connecting said cylinder and said steering arm so that said steering arm swings said propulsion unit about the steering axis in response to movement of said cylinder axially of said rod and for affording lost motion between said cylinder and said steering arm in the direction transverse to said rod, and means for selectively supplying hydraulic fluid to and drainging hydraulic fluid from said opposite ends of said cylinder so as to selectively displace said cylinder axially of said rod, and thereby to steer said propulsion unit.

11. A marine propulsion device in accordance with claim 10 wherein said means connecting said cylinder and said steering arm comprises a stud on one of said cylinder and said steering arm, and an elongated slot which is located on the other of said cylinder and said steering arm, which receives said stud, and which extends in the direction generally perpendicular to said first axis.

12. A marine propulsion device comprising a first bracket adapted to be fixed relative to a boat transom, a second bracket, means pivotally connecting said first and second brackets for swinging movement of said second bracket relative to said first bracket about a tilt axis which is substantially horizontal when said first bracket is boat mounted, a propulsion unit including a steering arm, means pivotally connecting said second bracket and said propulsion unit for steering movement of said propulsion unit relative to said second bracket about a steering axis which is generally transverse to the tilt axis and for swinging movement in common with said second bracket about said tilt axis, a pair of support arms, means supporting said support arms in spaced parallel relation and with said swivel bracket located therebetween, and for vertical swinging movement about said tilt axis, and against movement axially of, said tilt axis, a support rod mounted on said support arms and fixed against movement axially of said tilt axis, said support rod having common swinging movement with said propulsion unit about said tilt axis and including a central piston, a hydraulic cylinder receiving said piston and having opposed ends through which said rod passes, means connecting said cylinder and said steering arm for swinging said propulsion unit about the steering axis in response to movement of said cylinder axially of said rod and for affording lost motion between said cylinder and said steering arm in the direction transverse to said rod, and means for selectively supplying hydraulic fluid to and draining hydraulic fluid from said opposite ends of said cylinder so as to selectively displace said cylinder axially of said rod, and thereby to steer said propulsion unit.

13. A marine propulsion device comprising a first bracket adapted to be fixed relative to a boat transom, a second bracket, means pivotally connecting said first and second brackets for swinging movement of said second bracket relative to said first bracket about a first axis which is substantially horizontal when said first bracket is boat mounted, a propulsion unit including a steering arm extending above said first axis, means pivotally connecting said second bracket and said propulsion unit for steering movement of said propulsion unit relative to said second bracket about a steering axis which is generally transverse to said first axis, a threaded rod, spaced means located axially outwardly of said second bracket with respect to said first axis and supporting said threaded rod so that said threaded rod is located in spaced parallel relation to said first axis and is retained against movement axially of said first axis while permitting movement of said threaded rod in an arc about said first axis in common with vertical swinging movement of said second bracket, and for rotary movement about its own axis, a nut threadably engaged on said rod, means connecting said nut and said steering arm for preventing rotation of said nut with said rod so as thereby to displace said nut axially of said rod in response to rod rotation, and so that said steering arm swings said propulsion unit about the steering axis in response to movement of said nut axially of said rod, and for affording lost motion between said nut and said steering arm in the direction transverse to said rod, and means for selectively rotating said rod in opposite directions so as to selectively displace said nut axially of said rod and thereby to steer said propulsion unit.

14. A marine propulsion device in accordance with claim 13 wherein said means for selectively rotating said rod comprises a source of rotary power drivingly connected to said rod.

15. A marine propulsion device in accordance with claim 14 wherein said source of rotary power is a reversible electric motor.

16. A marine propulsion device in accordance with claim 14 wherein said source of rotary power is a reversible hydraulic motor.

17. A marine propulsion device in accordance with claim 13 wherein said means connecting said nut and said steering arm comprises a stud on one of said nut and said steering arm, and an elongated slot which is located on the other of said nut and said steering arm, which receives said stud, and which extends in the direction generally perpendicular to said first axis.

18. A marine propulsion device comprising a first bracket adapted to be fixed relative to a boat transom, a second bracket, means pivotally connecting said first and second brackets for swinging movement of said second bracket relative to said first bracket about a first axis which is substantially horizontal when said first bracket is boat mounted, said means pivotally connecting said first and second brackets including a tilt tube having opposite ends and tiltable with said second bracket, a propulsion unit including a steering arm extending above said first axis, means pivotally connecting said second bracket and said propulsion unit for steering movement of said propulsion unit relative to said second bracket about a steering axis which is generally transverse to said first axis, a threaded rod mounted on support arms extending from said opposite ends of said tilt tube, said threaded rod being fixed in spaced parallel relation to said tilt tube for common movement with said propulsion unit about said first axis, for rotary movement about its own axis, and against axial movement, a nut threadably engaged on said rod, means connecting said nut and said steering arm for preventing rotation of said nut with said rod so as thereby to displace said nut axially of said rod in response to rod rotation and so that said steering arm swings said propulsion unit about the steering axis in response to movement of said nut axially of said rod, and for affording lost motion between said nut and said steering arm in the direction transverse to said rod, and means for selectively rotating said rod in opposite directions so as to selectively displace said nut axially of said rod and thereby to steer said propulsion unit.

19. A steering accessory for a marine propulsion device comprising a first bracket adapted to be fixed relative to a boat transom, a propulsion unit including a steering arm, and means including a swivel bracket for pivotally connecting the first bracket and the propulsion unit for vertical swinging movement of the propulsion unit about a first axis which is substantially horizontal when the first bracket is boat mounted and which is located below the steering arm, and for swinging movement of the propulsion unit about a steering axis which is generally transverse to the first axis, said accessory comprising a support member, spaced means adapted to be located axially outwardly of the swivel bracket with respect to the first axis and supporting said support member so that said support member is located in spaced parallel relation to the tilt axis and is retained against movement axially of the first axis while permitting movement of said support member in an arc about the first axis in common with vertical swinging movement of the propulsion unit, a traveling member carried by said support member for movement therealong in directions parallel to the first axis, means adapted for connecting said traveling member and the steering arm for applying force to the steering arm so that the steering arm swings the propulsion unit about the steering axis in response to movement of said traveling member along said support member, and means on said support member and on said traveling member for reaction therebetween so as to selectively displace said traveling member along said support member to thereby steer the propulsion unit.

20. A steering accessory in accordance with claim 19 wherein said means adapted for connecting said traveling member and the steering arm includes means providing lost motion between said traveling member and the steering arm in the direction transverse to the tilt axis.

21. A steering accessory in accordance with claim 19 wherein said traveling member comprises a hydraulic cylinder which includes opposite ends and which is movable on said support member in response to selective application of pressure fluid to said opposite cylinder ends.

22. A steering accessory in accordance with claim 21 wherein said support member includes a support rod extending through both of said opposite ends of said cylinder and further including, within said cylinder, a piston fixed on said support rod.

23. A steering accessory in accordance with claim 19 wherein said support member comprises a threaded rod carried for rotation and against axial movement, wherein said traveling member comprises a nut on said threaded rod, and wherein said means for displacing said traveling member comprises a source of rotary power drivingly connected to said rod.

24. A steering accessory in accordance with claim 23 wherein said source of rotary power is a reversible electric motor.

25. A steering accessory in accordance with claim 23 wherein said source of rotary power is a reversible hydraulic motor.

26. A steering accessory in accordance with claim 19 wherein said means adapted for connecting said traveling member and the steering arm comprises a stud on one of said traveling member and the steering arm, and an elongated slot which is located in the other of said traveling member and the steering arm, which receives said stud, and which extends in the direction generally perpendicular to the first axis.

27. A steering accessory for a marine propulsion device comprising a bracket adapted to be fixed relative to a boat transom, a propulsion unit including a steering arm, and means pivotally connecting the bracket and the propulsion unit for vertical swinging movement of the propulsion unit about a first axis which is substantially horizontal when the bracket is boat mounted and which is located below the steering arm, and for swinging movement of the propulsion unit about a steering axis which is generally transverse to the first axis, in accordance with claim 19 wherein the means pivotally connecting the propulsion unit and the bracket including a tilt tube having opposite ends and tiltable with the propulsion unit, said accessory comprising support means including support arms adapted to extend from the opposite ends of the tilt tube, and a support rod supported by said support arms below the steering arm, parallel to the first axis, and for swinging movement in common with the propulsion unit about the first axis and against movement axially of the tilt tube, a member carried by said support rod for movement therealong in directions parallel to the first axis, means adapted for connecting said member and the steering arm for applying force to the steering arm so that the steering arm swings the propulsion unit about the steering axis in response to movement of said member along said support rod, and means on said support rod and on said member for reaction therebetween so as to selectively displace said member along said support rod to thereby steer the propulsion unit.

28. A steering accessory for an outboard motor comprising a first bracket adapted to be fixed relative to a boat transom, a second bracket, means pivotally connecting the first and second brackets for swinging movement of the second bracket relative to the first bracket about a first axis which is substantially horizontal when the first bracket is boat mounted, a propulsion unit including a steering arm located above the first axis, and means pivotally connecting the second bracket and the propulsion unit for steering movement of the propulsion unit relative to the second bracket about a steering axis which is generally transverse to the first axis, said steering accessory comprising a support rod including spaced portions and a piston located centrally between said spaced portions, spaced means adapted to be located axially outwardly of the second bracket with respect to the first axis and supporting said spaced rod portions so that said rod is located in spaced parallel relation to the first axis and is retained against movement axially of the first axis while permitting movement of said rod in an arc about the first axis in common with tiltable movement of the second bracket a hydraulic cylinder receiving said piston and having opposed ends through which said rod passes, means adapted for connecting said cylinder to the steering arm so that the steering arm swings the propulsion unit about the steering axis in response to movement of said cylinder axially of said rod and for affording lost motion between said cylinder and the steering arm in the direction transverse to said rod, and means for selectively supplying hydraulic fluid to and draining hydraulic fluid from said opposite end of said cylinder so as to selectively displace said cylinder axially of said rod, and thereby to steer the propulsion unit.

29. A steering accessory in accordance with claim 28 wherein said means adapted for connecting said cylinder and the steering arm comprises a stud on one of said cylinder and the steering arm, and an elongated slot which is located on the other of said cylinder and the steering arm, which receives said stud, and which extends in the direction generally perpendicular to the first axis.

30. A steering accessory for an outboard motor comprising a first bracket adapted to be fixed relative to a boat transom, a second bracket, means pivotally connecting the first and second brackets for swinging movement of the second bracket relative to the first bracket about a tilt axis which is substantially horizontal when the first bracket is boat mounted, a propulsion unit including a steering arm, and means pivotally connecting the second bracket and the propulsion unit for steering movement of the propulsion unit relative to the second bracket about a steering axis which is generally transverse to the tilt axis and for swinging movement in common with the second bracket about the tilt axis, said steering accessory comprising a pair of support arms, means adapted for supporting said support arms in spaced parallel relation, and with said second bracket located therebetween, and for vertical swinging movement about the tilt axis, and against movement axially of the tilt axis, a support rod mounted on said support arms and fixed against movement axially of the tilt axis, said support rod being swingable in common with the propulsion unit about the tilt axis and including a central piston, a hydraulic cylinder receiving said piston and having opposed ends through which said rod passes, means adapted for connecting said cylinder to the steering arm for swinging the propulsion unit about the steering axis in response to movement of said cylinder axially of said rod and for affording lost motion between said cylinder and the steering arm in the direction transverse to said rod, and means for selectively supplying hydraulic fluid to and draining hydraulic fluid from said opposite ends of said cylinder so as to selectively displace said cylinder axially of said rod, and thereby to steer the propulsion unit.

31. A steering accessory for an outboard motor comprising a first bracket adapted to be fixed relative to a boat transom, a second bracket, means pivotally connecting the first and second brackets for swinging movement of the second bracket relative to the first bracket about a first axis which is substantially horizontal when the first bracket is boat mounted, a propulsion unit including a steering arm extending above the first axis, and means pivotally connecting the second bracket and the propulsion unit for steering movement of the propulsion unit relative to the second bracket about a steering axis which is generally transverse to the first axis, said steering accessory comprising a threaded rod, spaced means adapted to be located axially outwardly of said second bracket with respect to the first axis and supporting said threaded rod so that said threaded rod is located in spaced parallel relation to the first axis and is retained against movement axially of the first axis while permitting movement of said threaded rod in an arc about the first axis in common with swinging movement of the second bracket, and for rotary movement about its own axis, a nut threadably engaged on said rod, means adapted for connecting said nut to the steering arm for preventing rotation of said nut with said rod so as thereby to displace said nut axially of said rod in response to rod rotation and so that the steering arm swings the propulsion unit about the steering axis in response to movement of said nut axially of said rod, and for affording lost motion between said nut and the steering arm in the direction transverse to said rod, and means for selectively rotating said rod in opposite directions so as to selectively displace said nut axially of said rod and thereby to steer the propulsion unit.

32. A steering accessory in accordance with claim 31 wherein said means for selectively rotating said rod comprises a source of rotary power drivingly connected to said rod.

33. A steering accessory in accordance with claim 32 wherein said source of rotary power is a reversible electric motor.

34. A steering accessory in accordance with claim 32 wherein said source of rotary power is a reversible hydraulic motor.

35. A steering accessory in accordance with claim 31 wherein said means adapted for connecting said nut to the steering arm comprises a stud on one of said nut and the steering arm, and an elongated slot which is located on the other of said nut and the steering arm, which receives said stud, and which extends in the direction generally perpendicular to the first axis.

36. A steering accessory for an outboard motor comprising a first bracket adapted to be fixed relative to a boat transom, a second bracket, means pivotally connecting the first and second brackets for swinging movement of the second bracket relative to the first bracket about a tilt axis which is substantially horizontal when the first bracket is boat mounted, a propulsion unit including a steering arm, and means pivotally connecting the second bracket and the propulsion unit for steering movement of the propulsion unit relative to the second bracket about a steering axis which is generally transverse to the tilt axis, said steering accessory comprising a threaded rod, spaced means adapted to be located axially outwardly of the second bracket with respect to the tilt axis and supporting said threaded rod for rotary movement about its own axis and so that said threaded rod is located in spaced parallel relation to the tilt axis and is retained against movement axially of said tilt axis while permitting movement of said threaded rod in an arc about the tilt axis in common with vertical swinging movement of said second bracket, a nut threadably engaged on said rod, means adapted for connecting said nut to the steering arm for preventing rotation of said nut with said rod so as thereby to displace said nut axially of said rod in response to rod rotation, and thereby to swing the propulsion unit about the steering axis in response to movement of said nut axially of said rod, and for affording lost motion between said nut and the steering arm in the direction transverse to said rod, and means for selectively rotating said rod in opposite directions so as to selectively displace said nut axially of said rod and thereby to steer the propulsion unit.

37. A marine propulsion device comprising a bracket adapted to be fixed relative to a boat transom, a propulsion unit including a steering arm, means pivotally connecting said bracket and said propulsion unit for vertical swinging movement of said propulsion unit about a first axis which is located below said steering arm and which is substantially horizontal when said bracket is boat mounted, and for swinging movement of said propulsion unit about a steering axis which is generally transverse to the first axis, a support member, spaced means supporting said support member so that said support member is located in spaced parallel relation to said first axis and is retained against movement axially of said first axis while permitting movement of said support member in an arc about said first axis in common with vertical swinging movement of said propulsion unit, a traveling member carried by said support member for movement therealong in directions parallel to said first axis, means connecting said traveling member and said steering arm for applying force to said steering arm so that said steering arm swings said propulsion unit about the steering axis in response to movement of said traveling member along said support member, and means on said support member and on said traveling member for reaction therebetween so as to selectively displace said traveling member along said support member to thereby steer said propulsion unit.

38. A steering accessory for a marine propulsion device comprising a bracket adapted to be fixed relative to a boat transom, a propulsion unit including a steering arm, means pivotally connecting the bracket and the propulsion unit for vertical swinging movement of the propulsion unit about a first axis which is located below the steering arm and which is substantially horizontal when the bracket is boat mounted, and for swinging movement of the propulsion unit about a steering axis which is generally transverse to the first axis, said accessory comprising a support member, spaced means connected to said support member for support thereof and adapted to locate said support member in spaced parallel relation to the first axis and to retain said support member against movement axially of the first axis while permitting movement of said support member in an arc about the first axis in common with vertical swinging movement of the propulsion unit, a traveling member carried by said support member for movement therealong in directions parallel to the first axis, means adapted for connecting said traveling member to the steering arm for applying force to the steering arm so that the steering arm swings the propulsion unit about the steering axis in response to movement of said traveling member along said support member, and means on said support member and on said traveling member for reaction therebetween so as to selectively displace said traveling member along said support member to thereby steer the propulsion unit.

* * * * *